US005300982A

United States Patent [19]

Inamoto et al.

[11] Patent Number: 5,300,982

[45] Date of Patent: Apr. 5, 1994

[54] APPARATUS FOR CONTROLLING IMAGE LOCATION ON MEDIUM

[75] Inventors: Kiyoshi Inamoto, Sakai; Masato Tokishige, Nara, both of Japan

[73] Assignee: Sharp Kabushiki Kaisha, Osaka, Japan

[21] Appl. No.: 845,926

[22] Filed: Mar. 4, 1992

[30] Foreign Application Priority Data

Mar. 5, 1991 [JP] Japan ..... 3-038612

[51] Int. Cl.[5] ..... G03G 21/00; G03G 15/16; G03G 15/01

[52] U.S. Cl. ..... 355/208; 355/275; 355/326 R

[58] Field of Search ..... 355/272, 274, 275, 212, 355/281, 317, 316, 326, 208, 271

[56] References Cited

U.S. PATENT DOCUMENTS 4,646,164 2/1987 Kishi ..... 355/271 X
4,788,572 11/1988 Slayton et al. ..... 355/317
5,159,390 10/1992 Imaizumi ..... 355/212

FOREIGN PATENT DOCUMENTS 57-111553 7/1982 Japan .

OTHER PUBLICATIONS

"Means for synchronizing electrophotographic copier", Chrestensen, Research Disclosure, Nov. 1978, 17513.

*Primary Examiner*—A. T. Grimley
*Assistant Examiner*—Shuk Y. Lee
*Attorney, Agent, or Firm*—David G. Conlin; George W. Neuner

[57] ABSTRACT

An apparatus (10) for controlling a location of an image on a conductive transfer belt (15), the conductive transfer belt having a hole (14) and for transferring a plurality of images formed on a photosensitive belt (11), the apparatus includes a transparent photosensor (16) for sensing a location of the hole and for supplying a signal indicating the sensed location, and a microprocessor (CPU) for controlling a relative location of the conductive transfer belt with respect to the photosensitive belt, the microprocessor serving to transfer a plurality of images formed on the photosensitive belt onto different locations on the conductive transfer belt in accordance with the signal.

7 Claims, 4 Drawing Sheets

APPARATUS FOR CONTROLLING IMAGE LOCATION ON MEDIUM

BACKGROUND OF THE INVENTION

1. Field of the Invention

The present invention relates to an apparatus for adjusting an image location on a medium, more particularly, the apparatus which is capable of controlling a position at where an image is depicted on a medium and is used for a color copying machine.

2. Description of the Related Art

The inventors of the present invention know that a color copying machine known which is operated in the following manner in order to form a color image on a transfer medium.

The operation of the above-mentioned known copying machine includes the steps of giving a mark to a reference location on the transfer medium, sensing the given mark with a sensor, and transferring respective color images on the different places of the transfer medium so as to control a timing for forming a subject image on the basis of the information sent from the sensor.

As will be understood from the above-mentioned operation, the known color copying machine keeps an image-created location at a predetermined distance from the reference point on the transfer medium. Therefore, in case that a lot of same-sized images are created, the toner is transferred and a cleaning unit is pressurized on the same place of the transfer medium in any image so that the transfer medium may be abraded at one place while those images are copied over and over for a long period. The abraded medium may disadvantageously result in having an adverse effect on forming of the copy image.

SUMMARY OF THE INVENTION

It is therefore an object of the present invention to provide an apparatus for controlling an image location on a transfer medium which is capable of copying images repetitively for a long period of time.

The object of the present invention can be achieved by an apparatus for controlling a location of an image on a transfer medium, the transfer medium having an index portion and for transferring a plurality of images formed on a photosensitive body, the apparatus includes a unit for sensing a location of the index portion and for supplying a signal indicating the sensed location, and a unit for controlling a relative location of the transfer medium with respect to the photosensitive body, the controlling unit serving to transfer a plurality of images formed on the photosensitive body onto different locations on the transfer medium in accordance with the signal.

Preferably, the apparatus is capable of keeping a timing for transferring each latent image as a constant so that a transfer of the latent images of three colors are started at a same location of the transfer medium, and the latent images are allowed to be overlapped on the same place of the transfer medium.

More preferably, the controlling unit serves to control a relative location of the transfer medium with respect to the photosensitive body so that an electrostatic latent image of each color is transferred from the photosensitive body to the transfer medium after a predetermined time being passed since the signal is output from the sensing unit, and the latent image of each color is transferred on the transfer medium at a predetermined distance from the index portion.

The controlling unit further serves to allow latent images of three colors to be overlapped on a same place of the transfer medium so that a subject image to be copied on the transfer medium is formed thereon.

Further preferably, the controlling unit serves to shift an n-th image at a distance of $\Delta p^* (n-1) = Vp^* \Delta t^* (n-1)$ off a first image on the transfer medium, with $\Delta p$ standing for a locational difference between an m-th image and an (m+1)th image, m and n being positive integer satisfying a relation $1 \leqq m \leqq n$, and Vp being a moving speed of the transfer medium at a time when n images are copied.

The transfer medium is a conductive transfer belt and the index portion is a hole formed on the conductive transfer belt, preferably.

The conductive transfer belt is preferably a middle transfer belt.

The sensing unit is preferably a transparent photosensor.

The control unit is a microprocessor, preferably.

The photosensitive body is preferably a photosensitive belt.

The middle transfer belt is composed of polycarbonate mingled with carbon, preferably.

In operation, the sensing unit serves to sense the location of the mark on the transfer medium and supply a signal indicating the location of the mark. In response to the location signal, the control unit serves to transfer a plurality of images formed on a photosensitive body on different locations on a middle transfer medium as changing the relative location of the transfer medium with respect to the photosensitive body.

Hence, the cleaning unit provided in the color copying machine keeps its pressurized location on the transfer medium changeable so that the transfer medium may be uniformly cleaned. This results in eliminating variation appearing on the surface of the transfer medium so that the image quality may be kept uniform. At a time, the life of the transfer medium is made longer.

Further objects and advantages of the present invention will be apparent from the following description of the preferred embodiment of the invention as illustrated in the accompanying drawings.

DESCRIPTION OF THE PREFERRED EMBODIMENT

Referring to the accompanying drawings, an embodiment of an apparatus for controlling an image location according to the present invention will be described in the followings.

Figure 1:
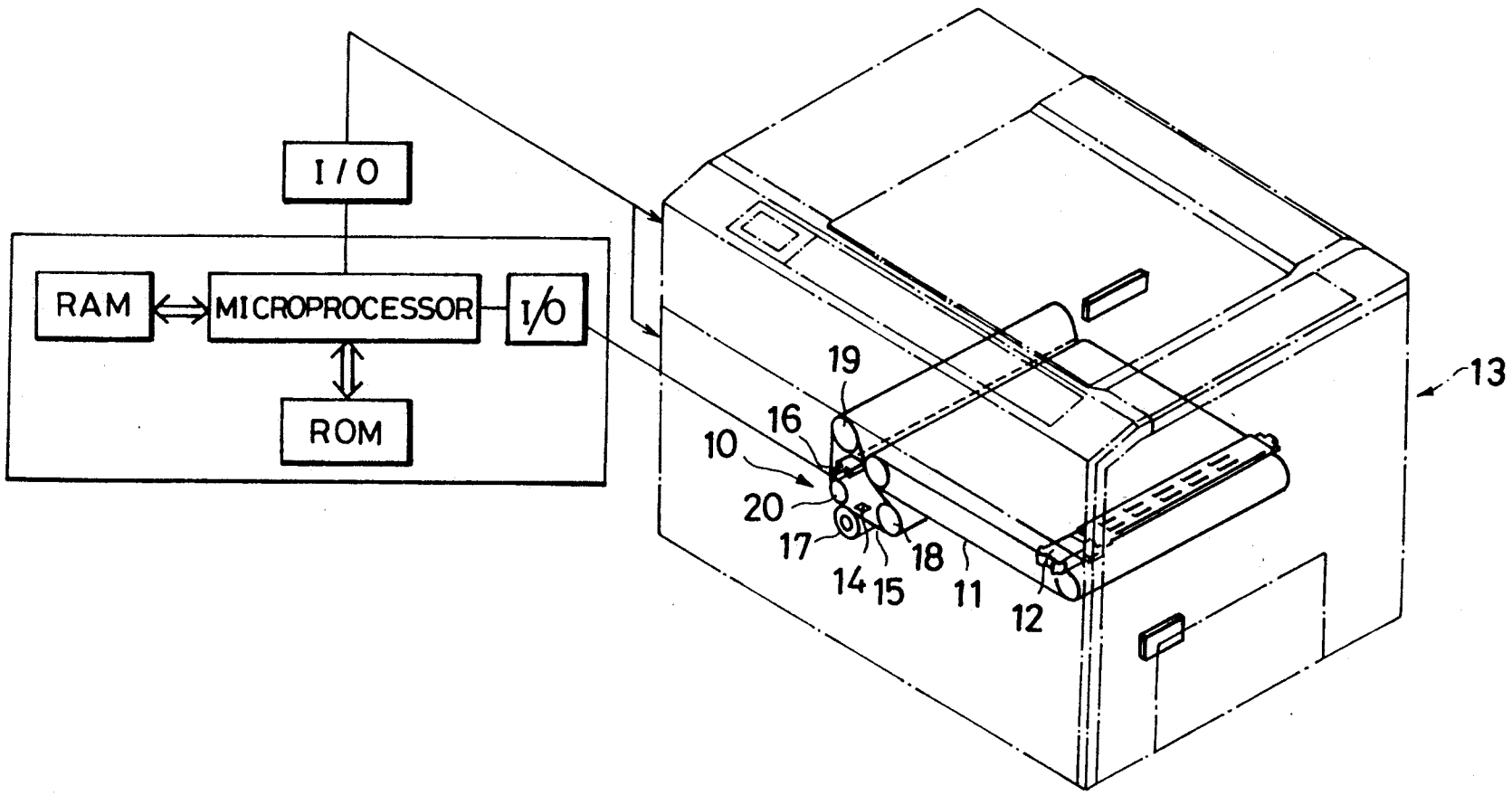
FIG. 1 is an illustration schematically showing an apparatus for controlling a location of an image on a transfer medium according to an embodiment of the present invention.

FIG. 1 schematically illustrates the apparatus for controlling an image location (referring as the image-location control apparatus, hereinafter) of an embodiment according to the present invention.

As shown, the image-location control apparatus 10 is located inside of a color copying machine 13.

The color copying machine 13 provides a photosensitive belt 11 and a main charger 12.

The image-location control apparatus 10 includes a middle transfer belt 15, a transparent photosensor (home location sensor) 16, and rollers 17, 18, 19, 20. The middle transfer belt 15 has a hole 14 through which the location of the belt is sensed. The transparent photosensor 16 senses the hole 14 so as to sense where the belt 15 is located.

The image-location control apparatus 10 further includes a microprocessor (referring as CPU in FIG. 1) which serves to control the relative location of the middle transfer belt 15 with respect to the photosensitive belt 11.

The rollers 17 to 20 serve to drive the middle transfer belt 15.

Then, the operation of the image-location control apparatus will be described by referring to FIGS. 1 and 2.

The image-location control apparatus 10 operates to sense the hole 14 formed on the middle transfer belt 15 with the transparent photosensor 16 so as to sense the reference location of the middle transfer belt 15. That is, the transparent photosensor 16 serves to supply a signal indicating the reference signal when it senses the hole 14. The signal will be referred to as a reference-location signal. This signal is used for accurately positioning and overlapping an image of each color, yellow, magenta and cyan (which will be described later).

Next, the description will be directed to the method of accurately positioning and transferring each electrostatic latent image formed on the photosensitive belt 11 onto the middle transfer belt 15.

The microprocessor CPU serves to control the relative location of the middle transfer belt 15 with respect to the photosensitive belt 11 so that the electrostatic latent image of each color may be transferred from the photosensitive belt 11 to the middle transfer belt 15 after a predetermined time $t_1$ (see FIG. 2) has passed since the reference-location signal is output from the transparent photosensor 16. It means that the latent image of each color is transferred on the middle transfer belt 15 at a predetermined distance from the hole 14.

The transferring operation allows the latent images of three colors to be overlapped on the same place of the middle transfer belt 15. This results in forming a subject image (to be copied) on the middle transfer belt 15. It will be recognized from the above description that the image-location control apparatus 10 enables to keep a timing for transferring each latent image constant so that the transfer of the latent images of three colors are started at the same location. In other words, since the timing for the latent images are kept constant, those images are allowed to be overlapped on the same place of the middle transfer belt 15, resulting in forming the subject image thereon.

Then, the overlapped three-color image is transferred from the middle transfer belt 15 to a sheet of paper. This is a termination of one copy.

Figure 2:
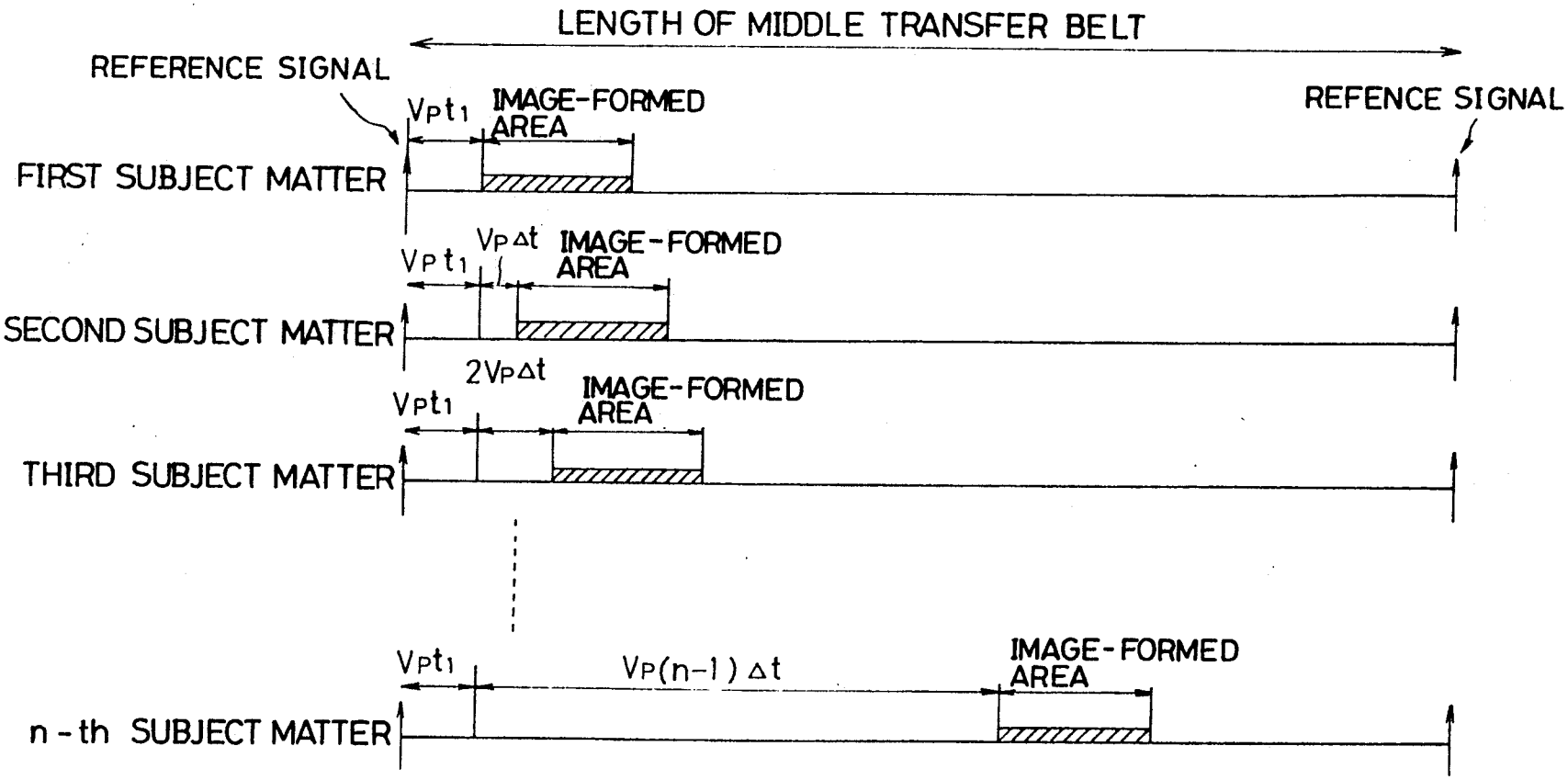
FIG. 2 is an explanatory view showing operation of the apparatus shown in FIG. 1.
Figure 3:
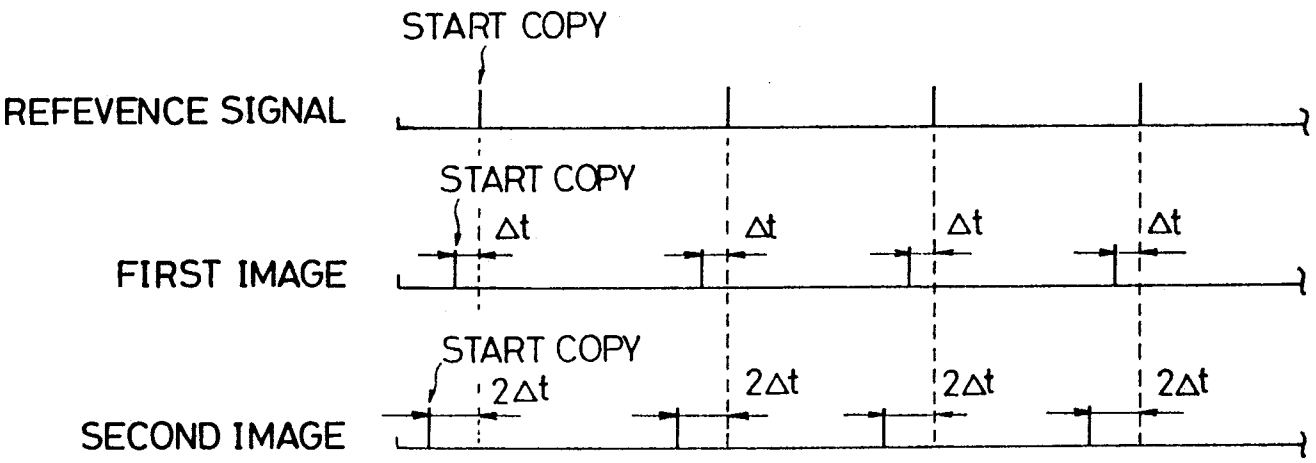
FIG. 3 is a timing chart showing a reference signal supplied from the apparatus shown in FIG. 1.

In turn, the description will be directed to a starting process for forming an image by referring to FIGS. 2 and 3.

As mentioned above, the first copy image is formed by transferring the image from the photosensitive belt 11 to the middle transfer belt 15 after the given time $t_1$ has passed since the reference-location signal is output from the transparent photosensor 16. Then, at a time when copying a second subject image, the electrostatic latent images of three colors are started to be formed after a time $t_1+\Delta t$ has passed since the reference-location signal is output. It means that on the middle transfer belt 15 the second images of three colors are shifted out of the first images by $$\Delta p = Vp * \Delta t$$

wherein $\Delta p$ denotes a locational difference between the current image and the previous image on the belt 15 and Vp denotes a moving speed of the middle transfer belt 15.

Hence, while copying n subject images (where, n is a positive integer satisfying a relation of $1 \leqq n$), the n-th subject image is shifted out of the first image location by $$\Delta p * (n-1) = Vp * \Delta t(n-1)$$

By continuously moving the location where the image is formed on the belt 15, the cleaning unit (not shown) keeps its pressurized location on the belt 15 in a moving mode so that the belt 15 is uniformly cleaned. This results in eliminating variation of the belt 15 which, otherwise, would have adversely effected on the quality of the resulting image.

Figure 4:
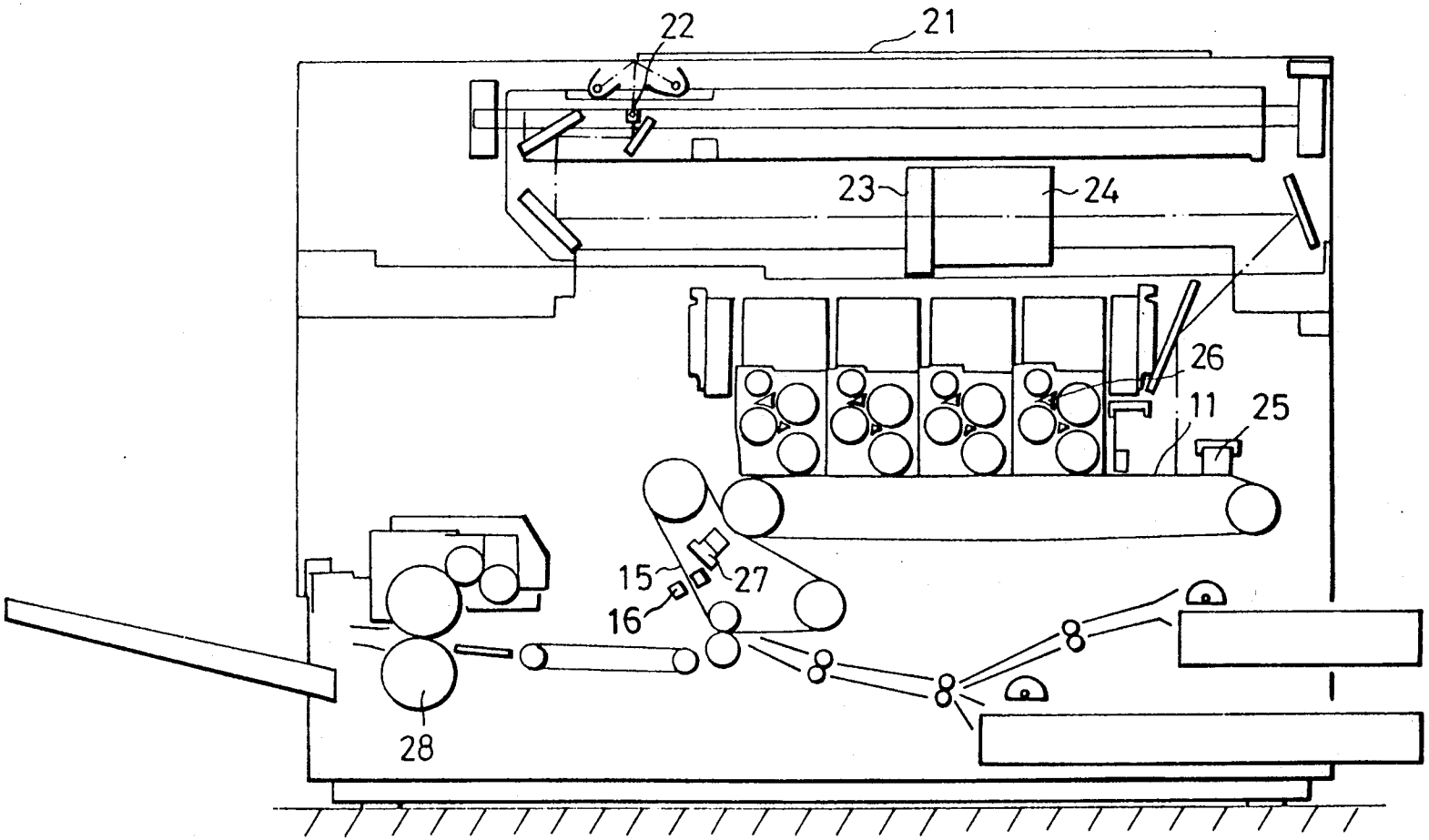
FIG. 4 is an illustration schematically showing the apparatus shown in FIG. 1 being applied to a color copying machine.

FIG. 4 is a section showing the color copying machine 13 to which the image-location control apparatus 10 shown in FIG. 1 is applied to be used.

The color copying machine 13 includes a platform 21 on which a subject matter to be copied (not shown) is placed, an exposing unit 22 which scans the subject matter from the inner side. The image picked up by the exposing unit 22 passes through a color separation filter 23 and a lens 24 and is projected on the photosensitive belt 11 which has been uniformly charged by the main charger 25. This results in forming an electrostatic latent image on the charged belt 11.

A developing unit 26 serves to fix toner on the photosensitive belt 11 for visualizing the electrostatic latent image on the photosensitive belt 11. A first transfer unit 27 serves to transfer the visualized latent image from the photosensitive belt 11 to the middle transfer belt 15. The subject matter is exposed three times for forming one image. It means that the electrostatic latent images of three colors are formed through the effect of the color-separation filters 23 of blue, green and red. These three latent images are developed by the corresponding colors, yellow, magenta and cyan each time the image is formed, and then the developed images are transferred onto the middle transfer belt 15.

When transferring the three electrostatic latent images on the middle transfer belt 15, these latent images are accurately positioned and overlapped on the middle transfer belt 15 in accordance with the aforementioned method. Then, the resulting image is transferred from the belt 15 to a sheet of paper. The image-copied paper is passed through a fixing unit 28 in which the toners of those colors attracted on the paper are resolved and mingled. After passing through the fixing unit 28, the same color image as the subject matter is formed on the sheet of paper.

The middle transfer belt 15 is preferably made of polycarbonate mingled with carbon.

Many widely different embodiments of the present invention may be constructed without departing from the spirit and scope of the present invention. It should be understood that the present invention is not limited to the specific embodiments described in the specification, except as defined in the appended claims.

What is claimed is:

1. An apparatus for controlling a location of an image on a transfer medium, said transfer medium having an index portion and for transferring a plurality of latent images formed on a photosensitive body, said apparatus comprising;

means for sensing a location of said index portion and for supplying a signal indicating said sensed location; and means for controlling a relative location of said transfer medium with respect to said photosensitive body, said controlling means being adapted to transfer a plurality of latent images formed on said photosensitive body onto different locations on said transfer medium in accordance with said signal, and being further adapted to shift an n-th image of said latent images at a distance of $\Delta p^*(n-1)=Vp^*\Delta t^*(n-1)$ off a first image of said latent images on said transfer medium, with $\Delta p$ representing a locational difference between an m-th image and an (m+1)th image of said latent images, $\Delta t$ representing a time difference between the m-th image and the (m+1)th image, m and n being positive integer which satisfy a relation $1 \leqq m \leqq n$, and Vp being a moving speed of said transfer medium at a time when n images are copied.

2. An apparatus according to claim 1, wherein said apparatus is capable of keeping a timing for transferring each latent image as a constant so that a transfer of the latent images of each of three colors are started at a same location of said transfer medium, and the latent images are allowed to be overlapped on said same place of said transfer medium.

3. An apparatus according to claim 1, wherein said controlling means enable to control a relative location of said transfer medium with respect to said photosensitive body so that an electrostatic latent image of each color is transferred from said photosensitive body to said transfer medium after a predetermined time has passed since said signal is output from said sensing means, and said latent image of each color is transferred on said transfer medium at a predetermined distance from said index portion.

4. An apparatus according to claim 1, wherein said controlling means enable to allow latent images of three colors to be overlapped on a same place of said transfer medium so that a subject image to be copied on said transfer medium is formed thereon.

5. An apparatus according to claim 1, wherein said transfer medium is a conductive transfer belt and said index portion is a hole formed on said conductive transfer belt.

6. An apparatus according to claim 5, wherein said conductive transfer belt is a middle transfer belt which is composed of polycarbonate mingled with carbon.

7. An apparatus according to claim 1, wherein said sensing means is a transparent photosensor, said control means is a microprocessor, and said photosensitive body is a photosensitive belt.

* * * * *